US006837764B2

(12) United States Patent
Bradley

(10) Patent No.: US 6,837,764 B2
(45) Date of Patent: Jan. 4, 2005

(54) MULTI-CHAMBERED FLOTATION DEVICE

(75) Inventor: Gary F. Bradley, Hendersonville, NC (US)

(73) Assignee: Simula, Inc., Tempe, AZ (US)

( * ) Notice: Subject to any disclaimer, the term of this patent is extended or adjusted under 35 U.S.C. 154(b) by 0 days.

(21) Appl. No.: 10/200,496

(22) Filed: Jul. 23, 2002

(65) Prior Publication Data

US 2003/0022566 A1 Jan. 30, 2003

Related U.S. Application Data

(60) Provisional application No. 60/307,392, filed on Jul. 25, 2001.

(51) Int. Cl.[7] ..... B63C 9/08

(52) U.S. Cl. ..... 441/106; 441/118

(58) Field of Search ..... 405/186; 441/88, 441/90–92, 98, 99, 106, 108, 111–120, 123

(56) References Cited

U.S. PATENT DOCUMENTS

| | | | | | |
|---|---|---|---|---|---|
| 1,375,803 | A | | 4/1921 | Soulliotis | |
| 1,385,581 | A | | 7/1921 | Pallady | |
| 1,904,767 | A | * | 4/1933 | Nakamura | 441/111 |
| 2,210,809 | A | | 8/1940 | Gray | |
| 2,550,562 | A | * | 4/1951 | Hurt et al. | 441/116 |
| 2,782,430 | A | * | 2/1957 | Radnofsky | 441/94 |
| 3,002,203 | A | * | 10/1961 | Moran | 441/118 |
| 3,068,500 | A | * | 12/1962 | Silverman | 441/118 |
| 3,076,207 | A | * | 2/1963 | Manhart | 441/118 |
| RE25,398 | E | * | 6/1963 | Moran | 441/111 |
| 3,329,982 | A | * | 7/1967 | Zannoni | 441/92 |
| 3,345,657 | A | * | 10/1967 | Peeler et al. | 441/92 |
| 3,716,882 | A | | 2/1973 | Middleton et al. | |
| 3,771,183 | A | | 11/1973 | Moran | |
| 4,297,758 | A | * | 11/1981 | Moran | 441/123 |
| 4,324,234 | A | | 4/1982 | Maness | |
| 4,671,775 | A | | 6/1987 | Hill | |
| 4,685,890 | A | * | 8/1987 | Edwards | 441/94 |
| 4,865,573 | A | * | 9/1989 | Switlik, Jr. et al. | 441/92 |
| 5,385,496 | A | * | 1/1995 | Seligman | 441/115 |
| 5,421,760 | A | | 6/1995 | Blaga | |
| 5,441,367 | A | * | 8/1995 | Toth | 405/186 |
| 5,494,469 | A | * | 2/1996 | Heath et al. | 441/118 |
| 5,692,933 | A | * | 12/1997 | Bradley et al. | 441/106 |
| 5,779,512 | A | | 7/1998 | Rupert | |
| 5,785,567 | A | * | 7/1998 | Modugno | 441/88 |
| 6,244,784 | B1 | * | 6/2001 | Gordon | 405/186 |
| 6,293,840 | B1 | * | 9/2001 | Garofalo | 441/108 |
| 6,346,022 | B1 | * | 2/2002 | Swanby et al. | 441/106 |
| 6,589,088 | B1 | * | 7/2003 | Maness | 441/106 |

FOREIGN PATENT DOCUMENTS

| | | | | | |
|---|---|---|---|---|---|
| GB | 2082979 | A | * | 3/1982 | B63C/9/08 |
| JP | 62181996 | A | * | 8/1987 | B63C/9/12 |
| JP | 07232697 | A | * | 9/1995 | B63C/9/08 |
| JP | 11105786 | A | * | 4/1999 | B63C/9/08 |
| JP | 11124088 | A | * | 5/1999 | B63C/9/08 |
| WO | PCT/US02/23350 | | | 7/2002 | |

* cited by examiner

*Primary Examiner*—S. Joseph Morano
*Assistant Examiner*—Ajay Vasudeva
(74) *Attorney, Agent, or Firm*—Shaw Pittman LLP

(57) ABSTRACT

A system for maintaining a user afloat in a fluid environment is disclosed. The system includes multiple chambers such that if one chamber fails to operate, redundant chambers will function to maintain the user afloat in a face-up position. In a preferred embodiment, there are multiple activation mechanisms to ensure inflation of the chambers if a single activation mechanism fails to function.

25 Claims, 13 Drawing Sheets

MULTI-CHAMBERED FLOTATION DEVICE

This application claims the benefit of U.S. Provisional Application No. 60/307,392, filed Jul. 25, 2001, which is incorporated by reference herein in its entirety.

BACKGROUND

1. Field of the Invention

The present invention relates to a device for maintaining a user afloat in a fluid. More particularly, the present invention relates to multi-chambered flotation devices that maintain a user floating in a fluid body.

2. Background of the Invention

Flotation devices have been used generally by passengers on sea vessels and lifeguards. Such devices promote flotation of the user typically by containing a pocket of air that helps to float a user at water level. Although such devices assist a user in maintaining afloat in water, the general shape and bulkiness of such devices tend to be so uncomfortable to the user that the user may choose not to wear such a device.

One type of a flotation device is a flotation collar, which keeps users afloat and decreases chances of drowning. Such collars are more specifically worn around the neck area and attempt to maintain the user's upper torso at or above water level. However, even such flotation collars are bulky and restrictive. If a wearer has a flotation collar around his or her neck, the wearer's movements are usually confined and defined by the shape and bulkiness of the flotation collar.

Flotation devices, such as a flotation collar, that have a single air chamber will fail to support a wearer if the chamber is punctured. Thus, if the unitary air chamber is non-functional, the user will not be assisted by the flotation device and will even have the extra weight burden of the device while trying to keep afloat.

Flotation collars that have redundant air chambers may not support the wearer in a stable, face-up position if one of the chambers is ruptured. Some of these devices, for example, are fabricated from materials that are very soft. Thus, if only one of the chambers is inflated, it is unlikely that the collar can support an unconscious or exhausted wearer in a face-up position because the soft material will crumble under the weight of the wearer which may result in the unconscious wearer's face remaining under water.

Furthermore, some flotation collars require the user to disassemble the unit into its separate components for cleaning and drying any time the collars get wet. This added burden of collar maintenance may not be followed by the wearer, and therefore result in degradation of the components of the collar. Such collars that are not maintained properly may not be functional when the need arises to keep a wearer afloat, which may result in drowning.

Furthermore, some wearers may need an additional assurance that a flotation device has a very low profile shape. Such wearers include military personnel who may have a lot of additional equipment to carry. Thus, a flotation device that requires too much room on a soldier's body may prevent the soldier from transporting other needed equipment, and hinder the arm movement of the soldier.

Accordingly, a need exists for a flotation collar that is comfortable to wear, easy to maintain, compatible with other survival gear, provides immediate support using redundant inflation components, provides stable support if one of the flotation cells fails, and maintains the wearer's head above water in a comfortable position.

SUMMARY OF THE INVENTION

The present invention is an environmentally-sealed flotation device housing multiple independent flotation cells. The flotation cells may be inflated using, for example, mechanically activated compressed $CO_2$ gas, one or more oral inflators, or the like. Other means for activating inflation of the device include, but are not limited to, automatic inflating devices that activate upon sensing moisture, pressure or altitude. Remote control devices also may be used to trigger activation of the flotation cells.

The flotation device has independent chambers, providing redundancy should one of the cells fail, for example, due to a rupture, leak, or failure of the inflation mechanism. Additionally, because of the positioning and design of the independent chambers, even if only one cell is inflated, support is provided on multiple sides of the wearer's body. Thus, if one of the cells fails or is punctured, the flotation collar has an inherent design that will maintain the wearer's head above water and orient the wearer face-up in the water. This positioning allows even an unconscious, injured, or exhausted wearer to breathe properly when such a person may have lost the ability to maintain his or head above water.

An exemplary embodiment includes two handles, for example, a left handle and a right handle, to mechanically activate the inflation mechanisms of two independent flotation cells. Both cells are automatically inflated with compressed $CO_2$ gas when either one or both handles are pulled. Each handle has the ability to activate multiple cell chambers. Thus, if one of the user's hands is injured and non-functional, the user may use the other hand to pull the handle that triggers the activation mechanism in the multiple cells.

The method of vacuum-and-pressure extraction of air from the environmentally-sealed cover is described in detail below and depicted in the attached figures and drawings. Vacuum sealing the flotation collar provides several benefits. One benefit of vacuum sealing is to protect the flotation cells and activation mechanism from dirt, water and other debris. Another benefit is to reduce the volume of the flotation collar (when deflated), thus making the collar more comfortable to wear, more maneuverable and less conspicuous. As described below and in the drawings, some exemplary embodiments of the present invention use a series of straps as attachment mechanisms for the environmentally-sealed cover.

Another exemplary embodiment of the flotation collar includes attachment mechanisms that integrate the flotation collar with an auxiliary belt and survival vest, parachute harness assembly, or other equipment that a user may wear.

An exemplary embodiment of the present invention is a flotation collar. The flotation collar includes an outer protective cover, an environmentally sealed cover, multiple inflatable flotation cells, and means for inflating the flotation cells, wherein a wearer is maintained in a substantially face up position in a body of liquid when the flotation cells are inflated, and wherein the wearer continues to be maintained in a substantially face up position if one of the flotation cells fails to inflate or becomes deflated.

Another exemplary embodiment of the present invention is a flotation device. The device includes a first inflatable cell, a second inflatable cell having no fluid communication with the first cell, an activation device for activating one or more the cells, wherein the cells are partially constructed of rigid materials, and when the cells are inflated to a certain pressure, a wearer will be rotated in a face-up position while floating in a fluid body, and wherein the wearer continues to be maintained in a substantially face up position if one of the flotation cells fails to inflate or becomes deflated.

Yet another exemplary embodiment of the present invention is a flotation device. The device includes multiple means for maintaining a user afloat in a fluid, means for activating any of the multiple means for maintaining, means for maintaining a user's body in a substantially upright position in the fluid, and means for housing the multiple means for maintaining in a substantially compact geometry.

In another exemplary embodiment, the present invention is a flotation device. The device includes multiple flotation cells, each flotation cell independently capable of maintaining a wearer substantially face up and afloat in a fluid, a compressed gas container, and multiple activation mechanisms, each activation mechanism capable of activating the compressed gas cylinder to release gas into all of the flotation cells.

Another exemplary embodiment of the present invention is a flotation device. The device includes two flotation cells, each flotation cell independently capable of maintaining a wearer substantially face up and afloat in a fluid, a common wall between the two flotation cells, the common wall having a limited area such that should one cell not inflate, then the other cell maintains the wearer in a face-up position in a body of fluid, a compressed gas container, and multiple activation mechanisms, each activation mechanism capable of activating the compressed gas cylinder to release gas into all of the flotation cells.

BRIEF DESCRIPTION OF THE DRAWINGS

FIG. 11*a* shows the completed step with exemplary cords attached to the pull tabs and FIG. 11*b* shows the attachment detail with the $CO_2$ cylinders removed.

DETAILED DESCRIPTION OF PREFERRED EMBODIMENTS

Flotation collars are described generally in U.S. Pat. No. 5,692,933 to Bradley, which is incorporated by reference herein in its entirety. Related art patents may disclose flotation collars having several independent compartments, such that if one of the compartments were to fail, the remaining compartments (if inflated) would still support the wearer in the water. However, in those devices, support is only provided from the neck up, such that the wearer would be positioned face-forward in the water. Also, some related art devices provide only unstable support if one of the air chambers were to fail, making it more difficult for the wearer to keep his or her head above water in a face-up position. Additionally, some of these devices, for example, are designed in a way that results in a variable center of buoyancy within a single cell if one of the cells fails. This inconsistent balance of the buoyancy in the cell reduces the ability of the collar to rotate an unconscious or exhausted wearer to a face-up position. Additionally, prior art flotation collars require the user to disassemble the unit when it needs to be either cleaned and dried.

The present invention is a multi-chambered flotation device. The shape and positioning of the inflatable cells and the material used to construct the device, among other features, ensure that the wearer's head is supported above water in a face-up position. The redundant chambers ensure that the wearer's head will still be supported if one of the chambers is punctured, fails to inflate or is otherwise not fully inflated.

Figure 1A:
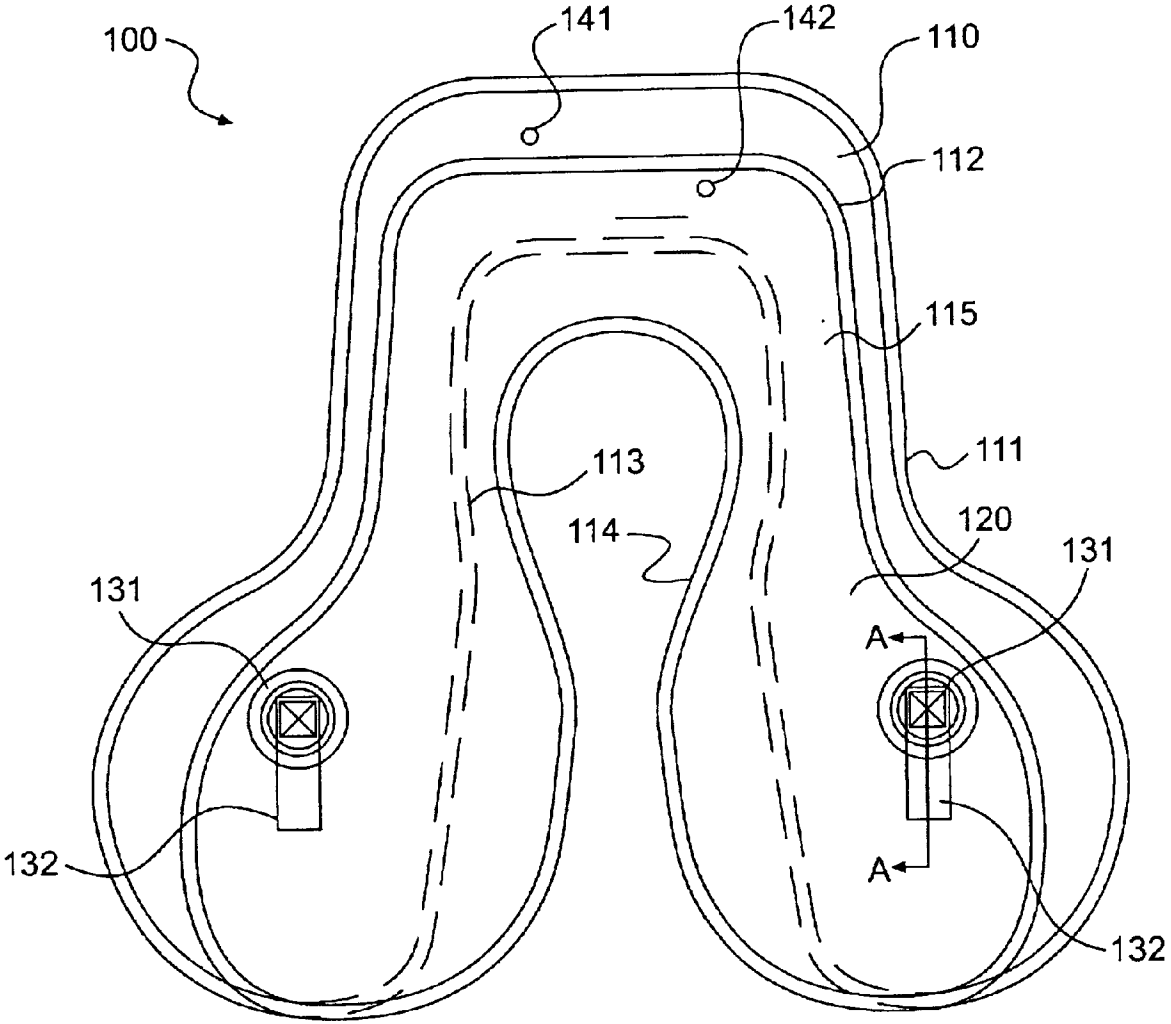
FIGS. 1*a* and 1*b* are schematic diagrams of a rear view and front view, respectively, of an assembly having multiple flotation cells according to an exemplary embodiment of the present invention.

An exemplary embodiment of the present invention is shown in FIG. 1*a* as flotation device 100. In this figure, the device 100 is shown from a rear view, relative to the position of a user wearing such a device. Multiple cells are shown, with each cell capable of maintaining a user afloat in fluid. Although two cells are shown in the exemplary embodiments for sake of simplicity, more than two cells are possible to increase the reliability of the backup cells even if one or more cells are not functioning properly.

A first cell 110 extends from outer seal 111 to inner seal 113. A second cell 120 extends from outer seal 112 to inner seal 114. The cells may be fabricated, for example, from a synthetic fabric coated on one or more sides with vinyl. Inflation valve stem 151 and 152, shown in FIG. 2*a*, will be mounted at stem flat guide locations 141 and 142, respectively. The valve stem 151 and 152 connect gas cylinders, which may be, for example, $CO_2$ cylinders, to first cell 110 and second cell 120, respectively. The second cell 120 is mounted behind the first cell 110 such that the second cell 120 partially covers the first cell 110, as shown in FIG. 1*a*. Such positioning maintains a broader floating body surface for a user.

In this exemplary embodiment, first cell 110 and second cell 120 have a common wall 115, that extends from seals outer seal 112 to inner seal 113. This common wall 115 forms a portion of the rear of the first cell 110 and the front of the second cell 120. The area of common wall 115 is limited, thus ensuring that should one cell be punctured, fail to fill or is otherwise not fully functional, then the other (fully-inflated) cell retains its overall shape and rigidity, maintaining the wearer in a face-up position above the water. FIG. 1*a* also shows retention strap attachment points 131 and attachment straps 132. The attachment straps 132 are used to keep the device 100 connected together and secured to the wearer, as shown, for example, in FIGS. 6*h*, 15*a* and 15*b*.

Figure 1B:
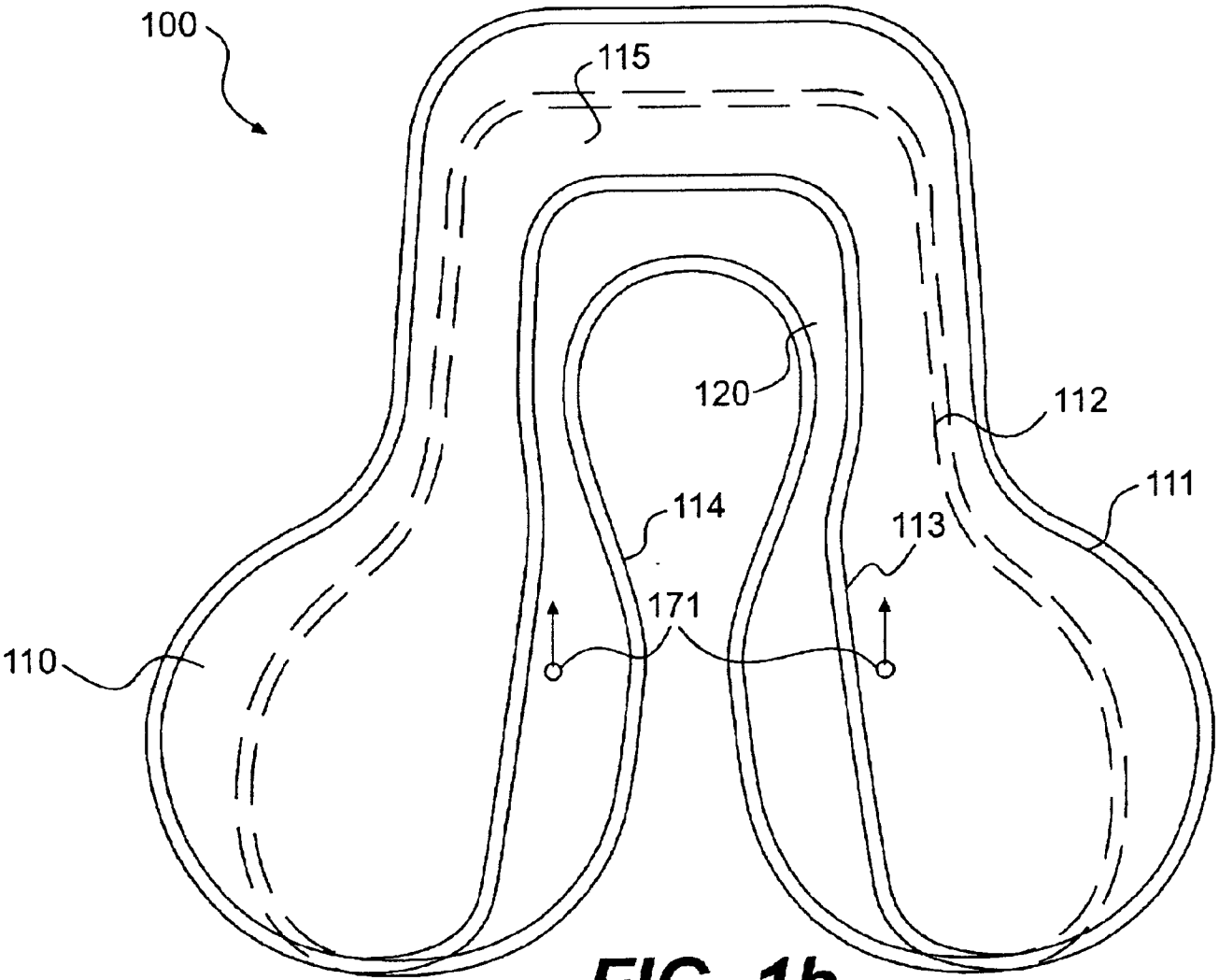

FIG. 1*b* is a front view of an exemplary embodiment of the flotation device 100 shown in FIG. 1*a*. Because FIG. 1*b* is a front view, and the first cell 110 is mounted in front of the second cell 120, the first cell 100 partially covers the second cell 120. FIG. 1*b* shows the oral inflator guides 171 for the oral inflators 170 (shown in FIG. 2*b*) on the first cell 110 and second cell 120.

The oral inflators 170 are back up systems in the exemplary device 100 shown in the figures. However, such oral inflators 170 may be the primary means for inflating the cells. Furthermore, although two oral inflators 170 are shown in the exemplary embodiments, only one is sufficient, or more than one may be used. The oral inflators 170 may be used when the gas cylinders that automatically inflate the cells are not functioning or are damaged. The wearer may access the oral inflator and blow into it thereby manually inflating the cells. Two oral inflators 170 are shown in the figures so that if one of the wearer's hands or arms is damaged, the wearer may use the other hand or arm to guide the oral inflator to his or her mouth and initiate manual inflation. Furthermore, each inflator 170 is preferably equipped with a mechanism, such as, for example, a one-way valve, that promotes air flow in one direction only and prevents back flow of air. This will prevent air that is blown into the cells from escaping.

Figure 2A:
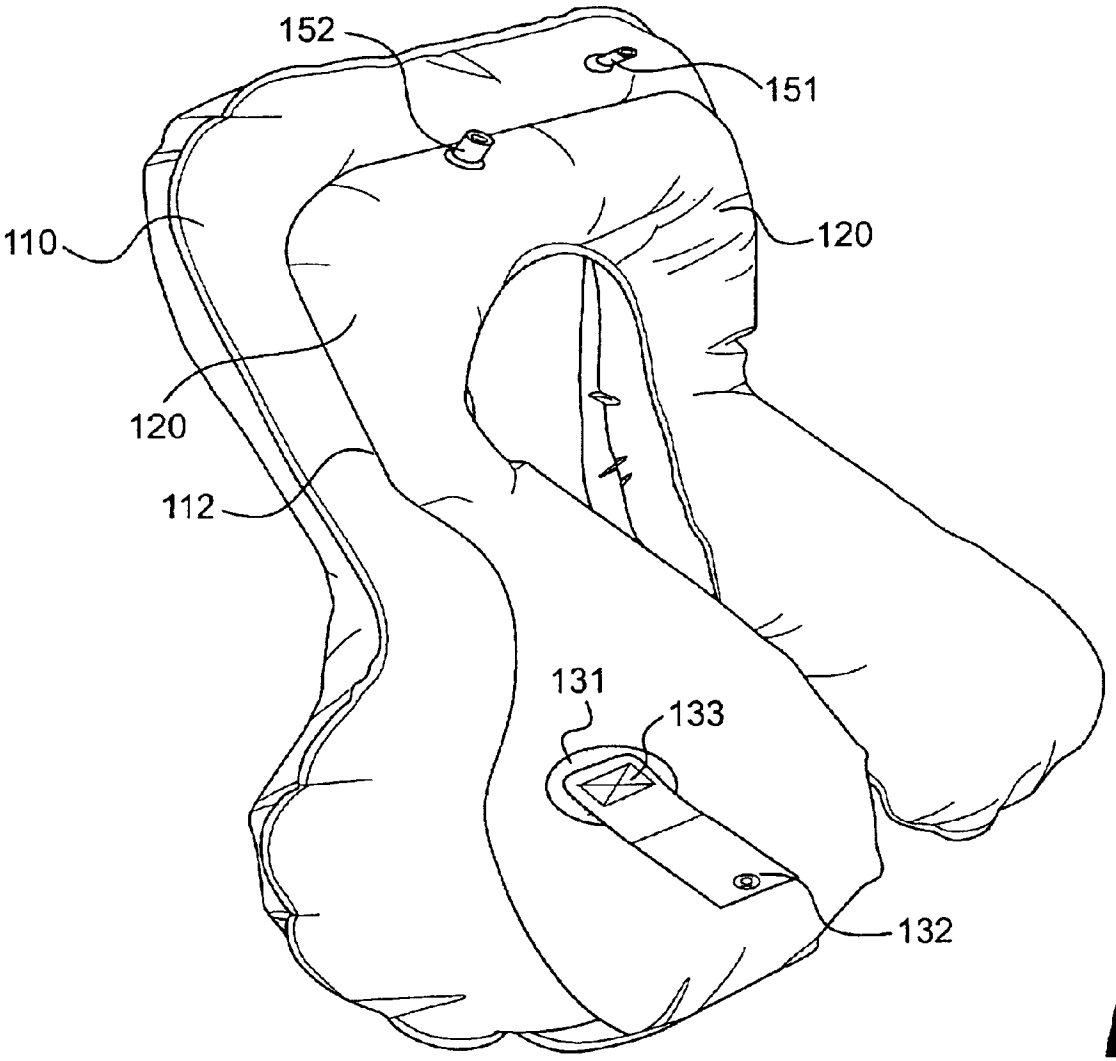
FIGS. 2*a* and 2*b* are diagrams of perspective views, from the rear and the front, respectively, of an exemplary embodiment of the present invention.
Figure 2B:
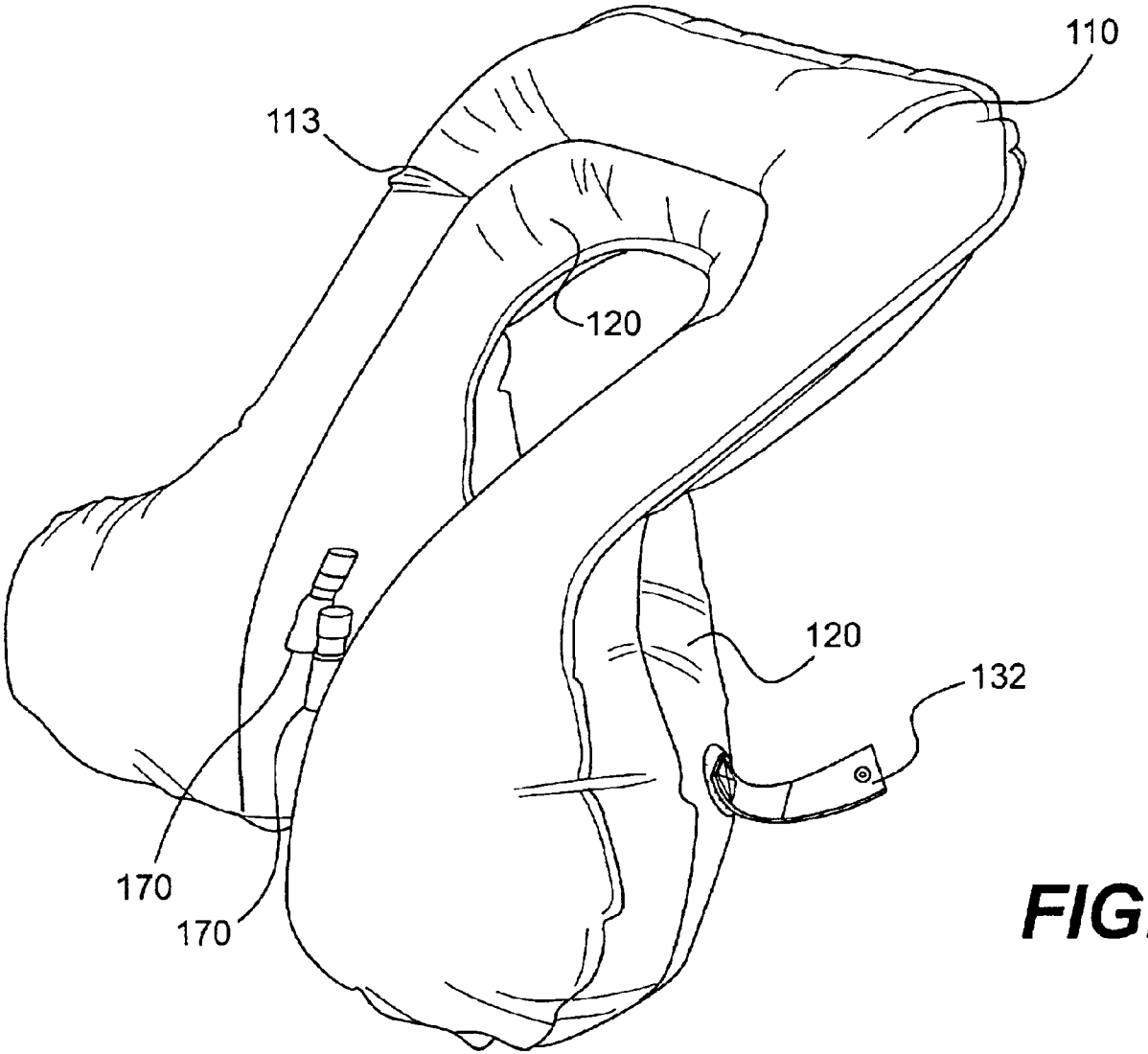

When inflated, the multiple cells of the flotation device 100 result in multi-layers of gas-filled compartments, as shown in FIGS. 2*a* and 2*b*. These figures show perspective diagrams from rear and front perspectives, respectively, of fully-inflated dual cells according to an exemplary embodiment of the present invention. Stems 151 and 152, protruding out from the first cell 110 and the second cell 120, respectively, connect these cells to compressed $CO_2$ cylinders (not shown in this Figure). Attachment strap 132 is attached to the cells at attachment point 131 using, for an example, an attachment stitch 133. Alternatively, slits may be used and straps may be led through the slits so that the straps connect outside components directly to interior components without having to be sewn to intermediate components.

Oral inflators 170, which are used in the exemplary embodiment as a redundant method of inflating the cells, are positioned generally below the wearer's mouth so that they are easily accessible by the wearer if such occasion arises. However, other positions for the inflators 170 is possible, such as higher on the device 100 and right next to the wearer's mouth to ease access.

Figure 3:
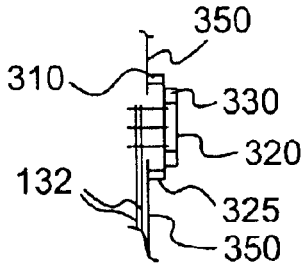
FIG. 3 is a schematic diagram illustrating an exemplary attachment strap connected to a flotation cell.

FIG. 3 shows the cross-section A—A from FIG. 1*a*. The exemplary attachment straps 132 are affixed to a flotation cell wall 350. Attachment straps 132, which may be constructed from heavy duty reinforced vinyl, are attached to disks 325 and 320 at, for example, attaching areas 310 and 330, respectively. The attaching areas may use stitching, glue, staples, welding, or the like, to attach the components together.

Figure 4:
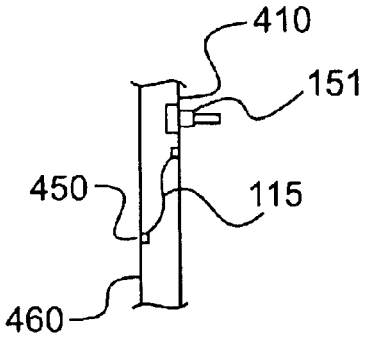
FIG. 4 is a schematic diagram of the cross-section of a cell wall of an exemplary embodiment.

The exemplary stem 151 is shown in FIG. 4 from a side perspective of the cell walls of an exemplary embodiment. Valve stem 151 is mounted through rear wall 410 of the first and second cells, close to the common wall 115 between the cells 110 and 120. The front side 460 of the cells is shown as on the opposite side of the stem 151. Seal areas 450 secure the cells 110 and 120 together. Such seal areas 450 may function by stitching, glue, welding, bonding, staples, or the like.

Figure 5:
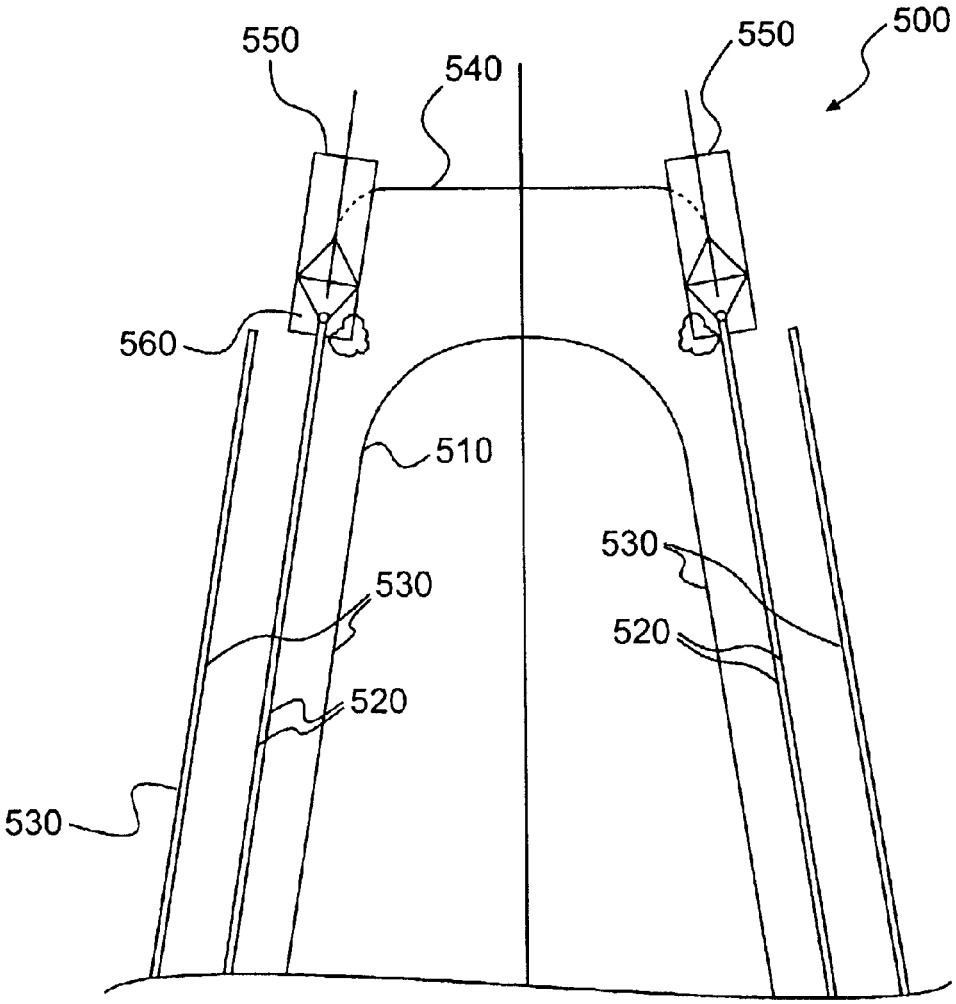
FIG. 5 is a schematic diagram of a top view of an exemplary environmentally-sealed cover assembly.

FIG. 5 is a schematic diagram of a top view of an exemplary environmentally sealed cover 500 of the present invention. The sealed cover 500 houses the one or more cells 110 and 120 and protects it from environmental effects that may dampen the integrity and functionality of multiple cells housed within. Such a sealed cover is also vacuum packed to ensure a tight seal with the enclosed cells. When the cells are activated to inflate, the sealed cover 500 is designed to rip at tear line 520 and top tear line 540. Such tearing motion is initiated by pulling of pull tabs 550 at a tear initiation point 560 when the wearer pulls on a pull string or handle. The sealed cover 500 contains seal line 530 that maintain the integrity of the sealed cover 500 when the tear lines 520 and 540 are ripped open and the enclosed cells are inflated.

In one exemplary embodiment shown, the initiation trigger is a pulling of activation strings that both assist in ripping open the sealed cover 500 at respective tear lines and at the same time trigger the compressed gas canisters to release their gas into the cells 110 and 120 through gas connectors that communicate with the cells through stems 151 and 152, respectively. However, the sealed cover 500 may not be desired to tear open at all such that the sealed cover is designed to be big enough to maintain multiple inflated cells within it, but is folded when not expanded due to inflation of the cells. If the sealed cover 500 is designed to not open at all during use, this would further protect the materials and integrity of the enclosed cells when the wearer is afloat in, for example, the ocean, and may be afloat for a long period of time before help arrives. Other mechanisms may be possible to separate the tearing process of the sealed cover 500, if needed at all, from the gas release from the compressed gas canisters.

Figure 6A:
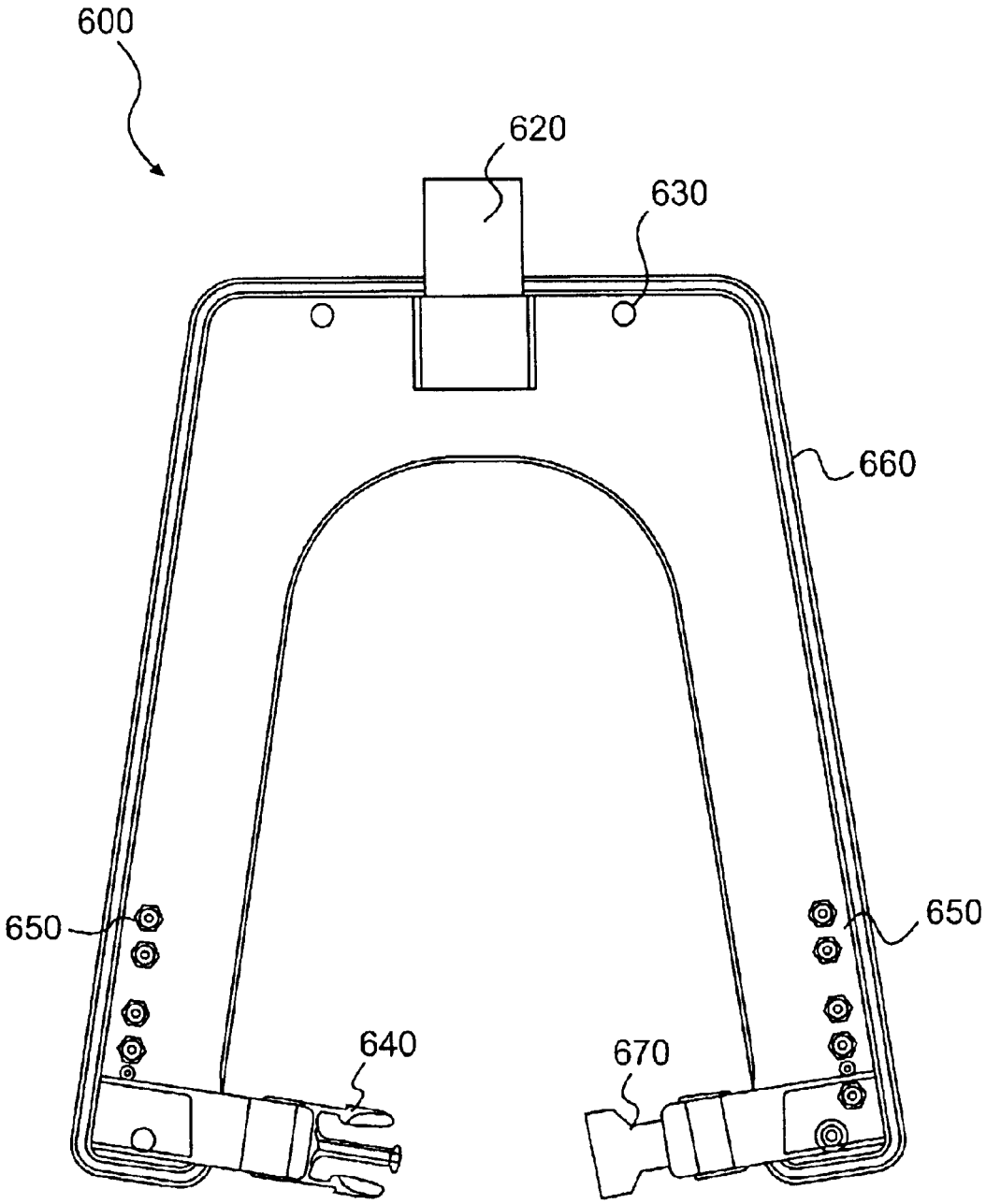
FIGS. 6*a* and 6*b* are schematic diagrams of rear and front views, respectively, of an exemplary outer cover of the present invention.
Figure 6B:
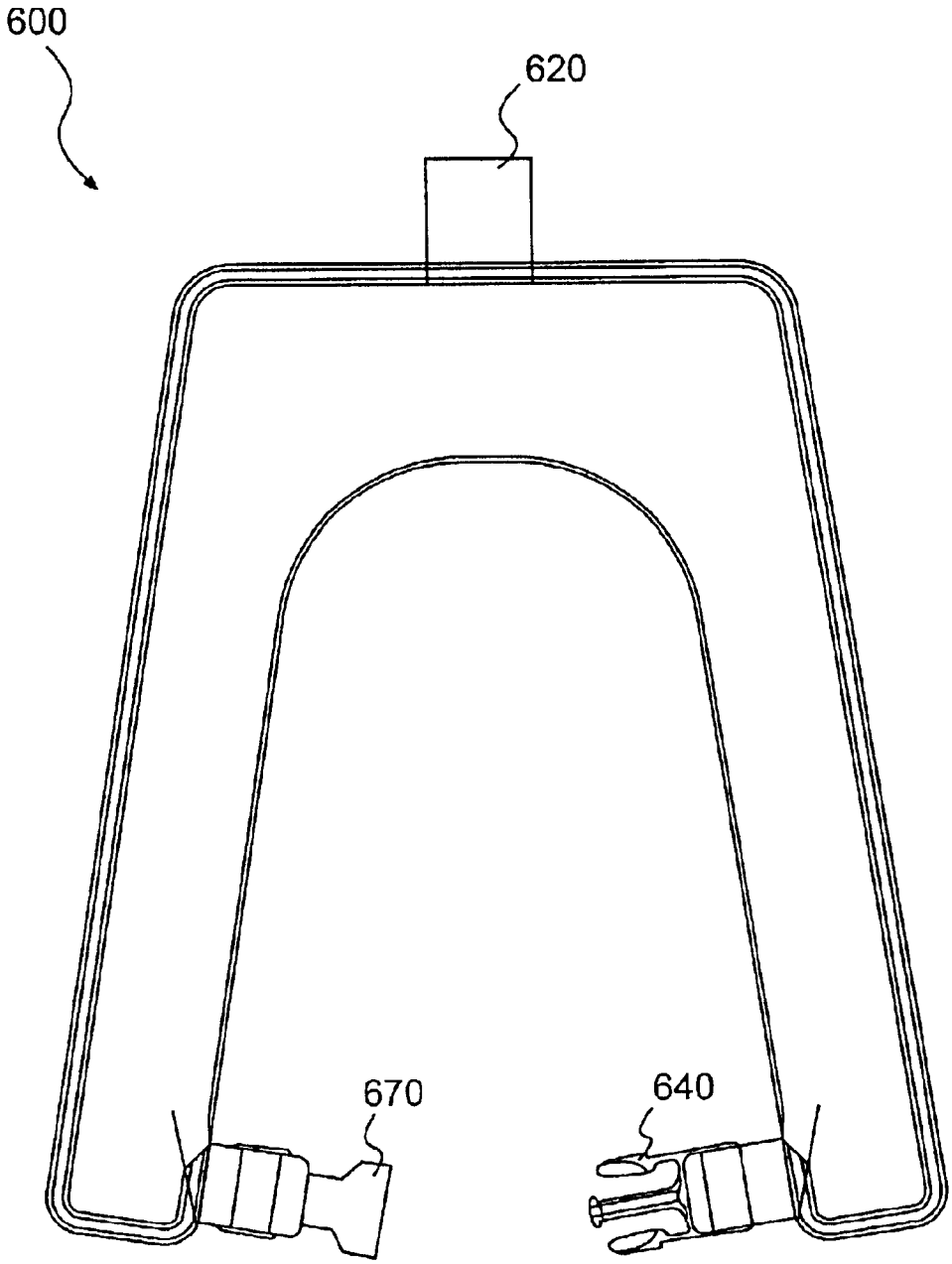

Covering the sealed cover 500, which house the cells 110 and 120, is an outside cover, such as the exemplary outer cover 600 shown in FIGS. 6*a* and 6*b*. The outer cover 600 may include a top zipper seal 620 (using, e.g., snaps, zipper, hook and loop type fasteners, such as VELCRO, or the like), grommets 630, beaded handle attachment snaps 650, male chest buckle 640 and female chest buckle 670. The straps from the cells transfer through an opening in seal 630, as explained in greater detail below, with reference to FIGS. 6*c*–6*h*. The male 640 and female 670 chest buckles are mated together when the user is wearing the cover 600 so that the device is secured around the user's neck and front chest area. The beaded handle attachment snaps 650 reversibly attach a handle (not shown) thereto in such a manner that with moderate force the handle is detached from the snaps 650. The handle is further connected to cords that promote the tearing of the outer cover 600 and the activation of the gas cylinders, as described below.

The outer cover 600 is typically constructed of a material that has been pre-coated with NIR dyes before such materials are made into the outer cover 600. This ensures that the NIR property of the material is an inherent property of the material and not a property that was later gained by a coating of the already constructed product. The NIR properties enable, for example, search and rescue operations to locate and save stranded wearer's who are wearing such covers 600 through use of special cameras that take advantage of such NIR properties.

Straps pass through the grommets 630 and attach the flotation collar to the wearer's vest, harness or other device. In this exemplary embodiment, beaded handles (not shown) snap into beaded handle snaps 650, as shown in FIG. 6*a*. When the wearer wishes to deploy this exemplary embodiment of the present invention, he or she pulls on either the left or right beaded handle, or on both of the beaded handles, which in turn pull pulltabs 550 (as referenced in FIG. 5). The ripping force created by pulling on the pulltabs 550 promotes the tearing of the outer cover 600 at tear line 660, and pulls pullcords attached to the activation levers on the $CO_2$ cylinders, releasing the compressed $CO_2$ and inflating the first and second cells.

Figure 6C:
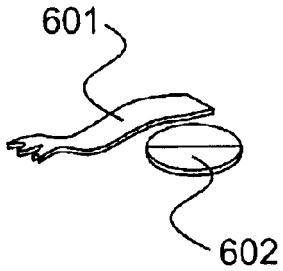
FIGS. 6*c–e* are schematic diagrams of exemplary straps and exemplary hardware used to attach the straps to the flotation cells.

The reinforced vinyl straps 601 are attached and routed as shown in FIGS. 6*c*–6*h*. FIG. 6*c* shows a strap 601 being placed on an attachment disk 602. Strap 601 is attached to attachment disk 602 by sewing, gluing, welding, or the like.

Figure 6D:
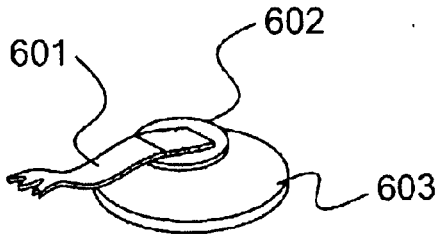
Figure 6E:
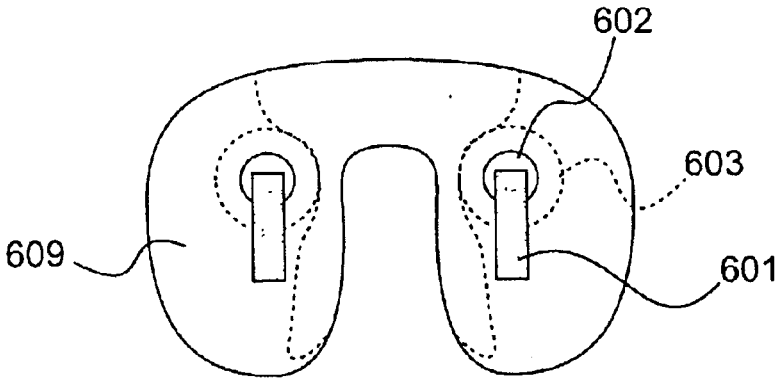

When strap 601 is attached to attachment disk 602, the combination is then is sealed, using, for example, heat or RF, to base disk 603, as shown in FIG. 6*d*. The base disk 603 is then sealed, using, for example, heat or RF, to the cell walls 609 of cells 110 and 120.

Figure 6F:
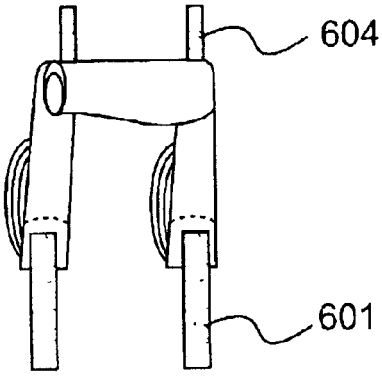
FIG. 6*f* is a schematic diagram of exemplary folded flotation cells.
Figure 6G:
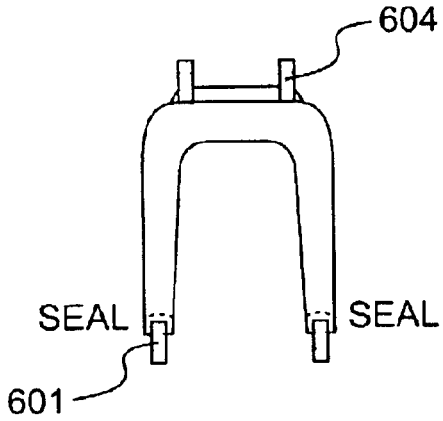
FIG. 6*g* is a schematic diagram of an exemplary environmentally-sealed cover.

The cells are then folded, for example, accordion style, into the environmentally-sealed cover. As shown in FIG. 6*f*, top straps 604 are attached to exemplary flotation cells by being bolted onto the bladder at stems 151 (from FIG. 4), using in this example a cap nut (not shown). The legs and the top of the environmentally-sealed cover 500 are sealed, for example, using glue, RF or heat, to the straps 601 and 604, as shown in FIG. 6*g*.

Figure 6H:
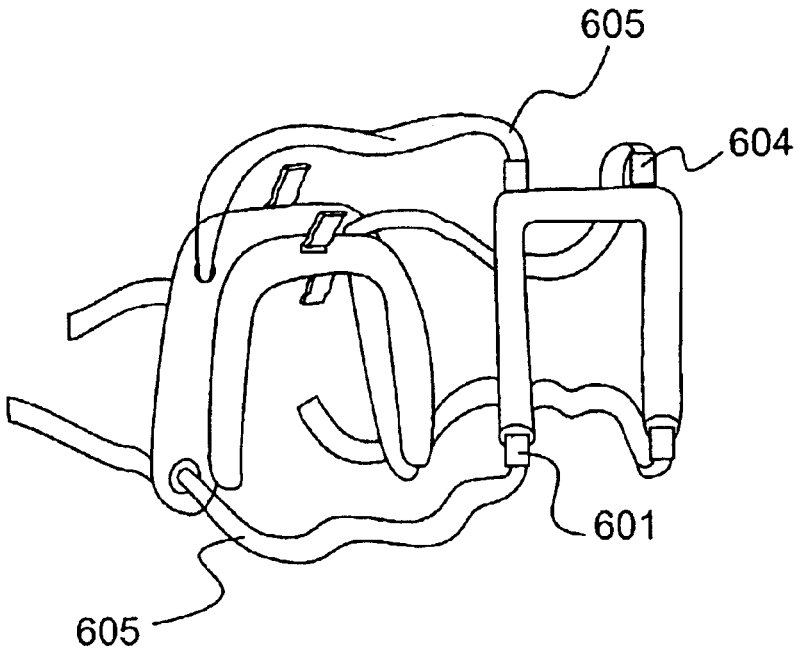
FIG. 6*h* is a schematic diagram of exemplary straps connected to an outer cover and illustrates how the straps are threaded through an exemplary environmentally-sealed cover.

FIG. 6*h* shows nylon straps 605 which are sewn to straps 604 and 601 on the environmentally-sealed cover, and then threaded through grommets in the outer protective cover 600. Nylon straps 605 can then be used to attach the flotation collar to the wearer's harness, or otherwise to secure the flotation collar to the wearer. Other attaching configurations are possible as long as the flotation cells are secured to the wearer's body in a snug and secure fashion.

Figure 7:
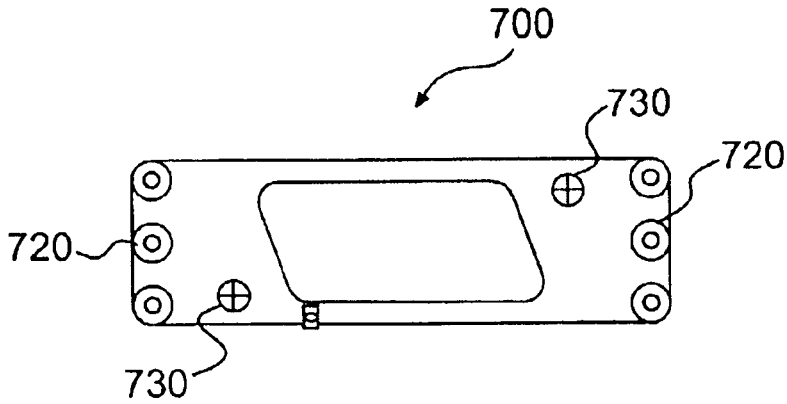
FIG. 7 is a schematic diagram of the base of an exemplary inflator mechanism housing.

The front of an exemplary inflator mechanism frame 700 is shown in FIG. 7. The frame 700 has been shown in one particular exemplary embodiment but other shapes and designs are possible as long as they function in the same manner. The frame 700 has threading guide holes 720 and inflation stem holes 730 which assist in maintaining the position of the frame 700 with respect to the wearer and within the overall flotation device. Although six guide holes 720 at particular locations are shown in the Figure, any number is possible at any location as long as they function in the same manner.

Although the above components may be assembled and configured together in a variety of ways to ensure that the eventual flotation device has all of the advantages set forth in this invention, the description set forth below in connection with FIGS. 8–17 will set forth an exemplary embodiment of an assembly procedure.

Figure 8A:
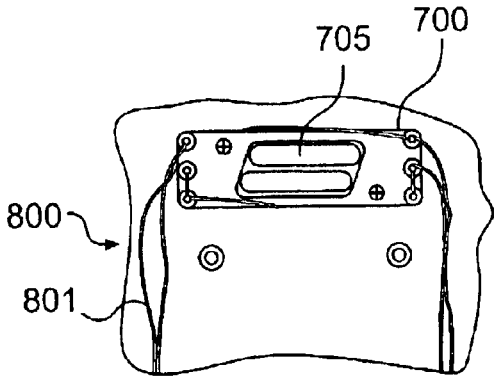
FIGS. 8*a* and 8*b* are schematic diagrams of the back and top side, respectively, of an exemplary inflation mechanism, pull cords, and cylinders of compressed $CO_2$ gas.
Figure 8B:
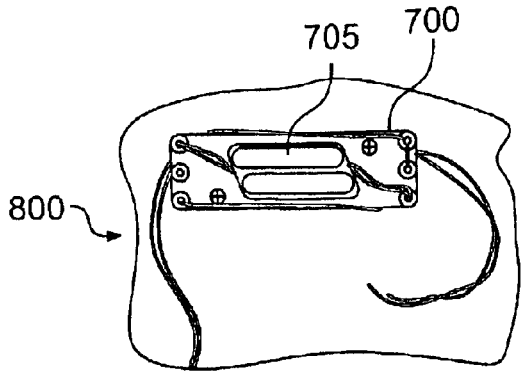

As shown in FIGS. 8*a* and 8*b*, to begin assembly of an embodiment of the internal components of device 800, multiple cylinders 705 of compressed $CO_2$ gas are housed in frame 700, as shown in FIGS. 8*a* and 8*b*. FIGS. 8*a* and 8*b* are diagrams of the back and top, respectively of an exemplary inflation activation mechanism. These cylinders 705 may be, for example, Hawkey-Roberts inflators. Other types of gas cylinders are possible as long as they are generally safe and easy to use. Furthermore, the gas cylinders may alternatively be positioned outside of the frame body 700 and at various location with respect to the user as long as the cylinders are accessible to the cells and don't substantially interfere with the movement of the wearer.

FIGS. 8*a*–8*b* shown the assembly procedure and relationship between the cylinders of compressed $CO_2$ gas 705 and the threaded pull cords 801. Pullcords 801 are connected to the pulltabs 550 (shown in FIG. 5) and are used to trigger inflation activators 705. When the wearer pulls on the cords, the inflation activators will release compressed $CO_2$ gas and inflate the first and second cells. The pull cords 801 are attached to pull tabs (not shown) on the cylinders 705. When the pull cords are pulled enough to move the pull tabs on the cylinders 705, gas is released without stop until the cylinders are substantially de-pressurized.

Figure 9:
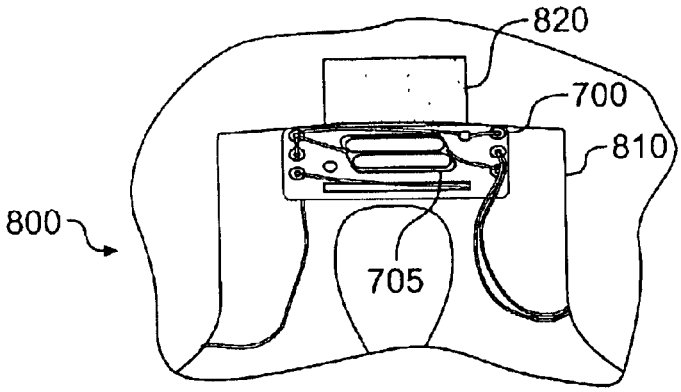
FIG. 9 is a schematic diagram of the top of an exemplary inflation mechanism mounted on exemplary flotation cells.

FIG. 9 shows the inflation mechanism that includes the activation frame 700 mounted with respect to flotation cells. A cover 820, which may be fabric, is used to protect the cylinders 705 and the activation mechanism from environment debris, moisture, and contaminants.

Figure 10:
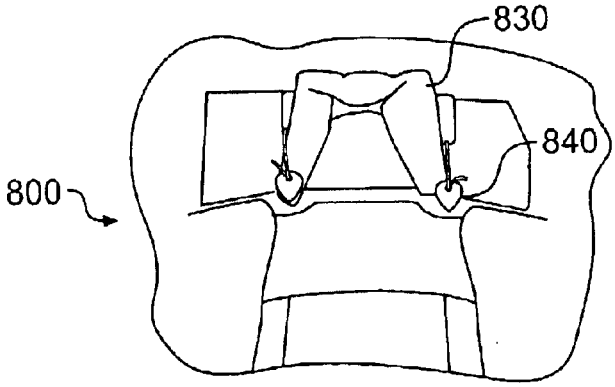
FIG. 10 is a schematic diagram of exemplary flotation cells and inflation mechanism inserted into a barrier bag for sealing.

As shown in FIG. 10, portions of the flotation cells and the activation mechanisms are inserted into an exemplary environmentally-sealed cover 830 for sealing. The lower lobes of the flotation cells are folded accordion-style and packed into the "legs" of the exemplary environmentally-sealed cover. The packing and folding methodology aims to minimize the volume of space required for the entire flotation collar, thereby making it less cumbersome for the wearer to wear.

Figure 11A:
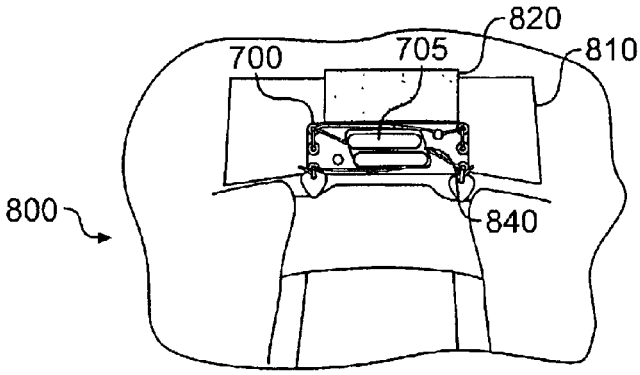
FIGS. 11*a* and 11*b* are schematic diagrams of an exemplary activation assembly attached to an environmentally-sealed cover.
Figure 11B:
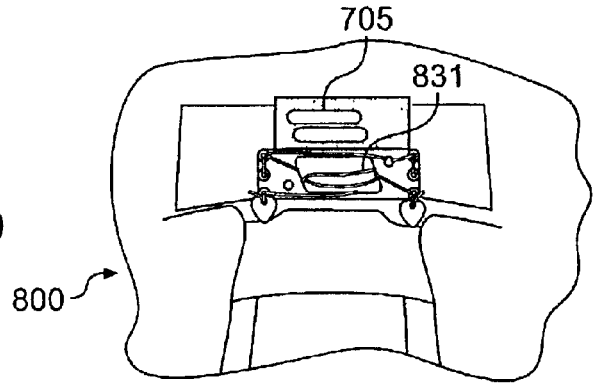

FIGS. 11*a* and 11*b* show the attachment of an exemplary inflation activation assembly to the environmentally-sealed cover. The cords 801 from the activation assembly are tied to the pull tabs 840 on the reverse side of the exemplary environmentally-sealed cover. FIG. 11*a* shows a completed step with cords 801 attached to pulltabs 840. FIG. 11*b* shows attachment detail of an exemplary inflation activation assembly, with a housing area 831 with the compressed $CO_2$ cylinders removed.

Figure 12:
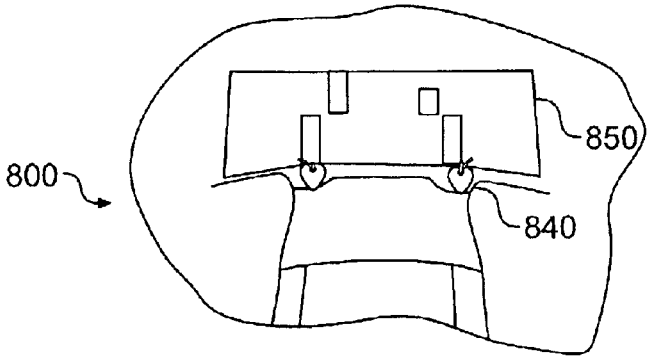
FIG. 12 is a schematic diagram of an exemplary cover used to house the activation assembly.
Figure 13:
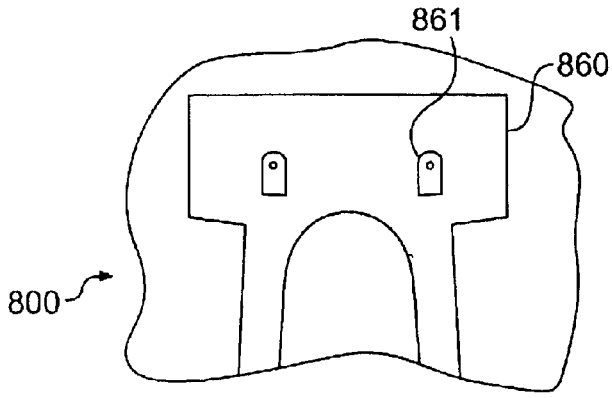
FIG. 13 is a schematic diagram of an exemplary environmentally-sealed bag and its tear channels.

FIG. 12 shows an exemplary cover 850 used to house an exemplary inflation activation assembly. FIG. 13 shows an exemplary environmentally-sealed cover 860, with its two tear channels 861. The tear channels ensure a consistent, reliable channel for breaking the seal and allowing the flotation cells to escape and deploy upon activation.

Figure 14A:
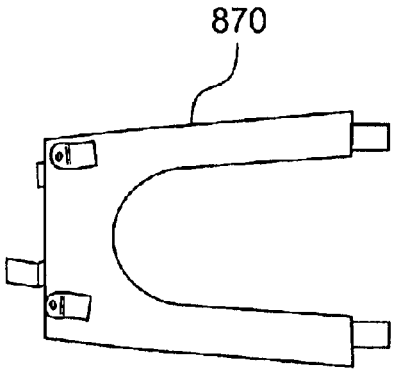
FIGS. 14*a* and 14*b* are schematic diagrams of the top and bottom, respectively, of an exemplary environmentally-sealed cover.
Figure 14B:
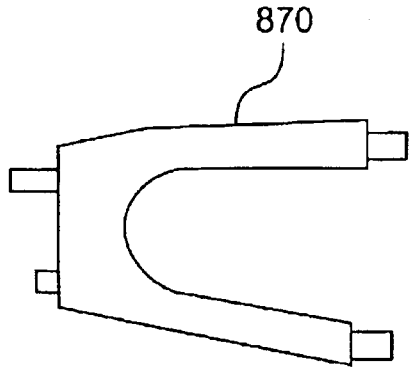

FIGS. 14*a* and 14*b* show the top side and bottom side, respectively, of an exemplary embodiment of an environmentally-sealed flotation device assembly 870. After the exemplary environmentally-sealed cover is closed, air is evacuated from the unit. The unit is then sealed at the bottom of the "legs" and at the top of the environmentally-sealed cover. The top cover may be vinyl, whereas the bottom may be vinyl-coated fabric. Use of different materials for the top and the bottom serves to amplify the pressure at the tear channels, and to minimize any stretching, which would otherwise dissipate the pressure and reduce the unit's reliability.

Figure 15A:
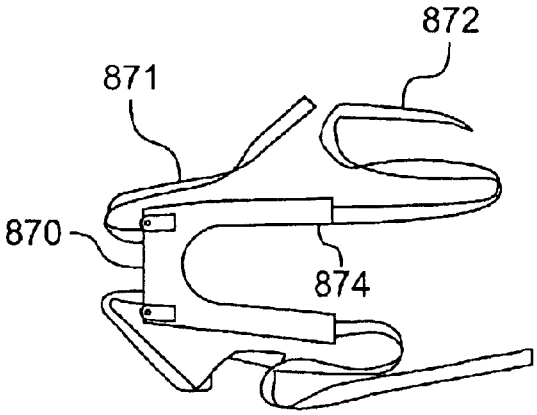
FIGS. 15*a* and 15*b* are schematic diagrams of front and back views, respectively, of exemplary attachment straps sewn onto attachment tabs protruding from an exemplary environmentally-sealed cover.
Figure 15B:
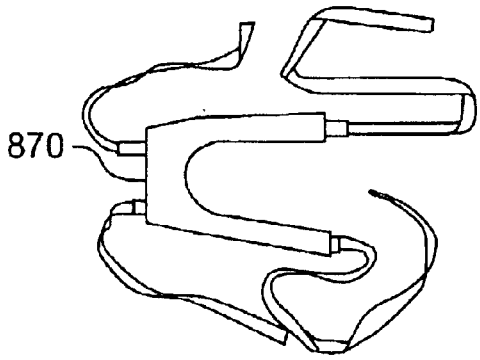

FIGS. 15*a* and 15*b* show the front side and back side, respectively, of an exemplary installation of attachment straps 871 and 872. The straps are standard nylon webbing attachment straps which are sewn onto the attachment tabs protruding from the environmentally-sealed cover.

Figure 16A:
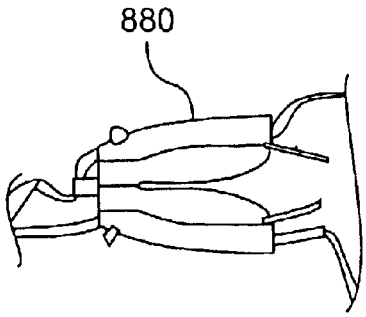
FIGS. 16*a*, 16*b*, and 16*c* are schematic diagrams showing an exemplary environmentally-sealed cover being installed inside an outer protective cover.
Figure 16B:
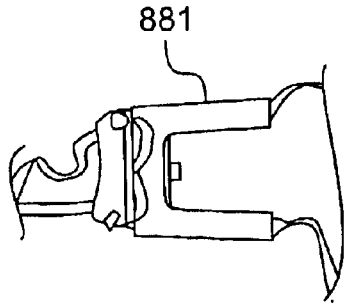
Figure 16C:
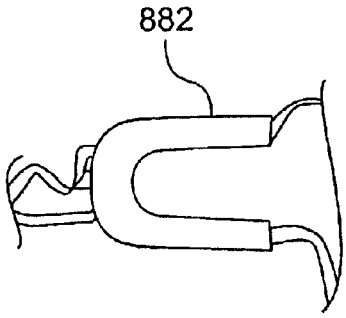
Figure 17A:
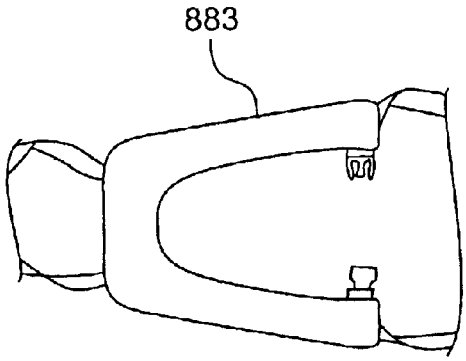
FIGS. 17*a* and 17*b* are schematic diagrams of the front and back views, respectively, of a completely assembled exemplary flotation collar.
Figure 17B:
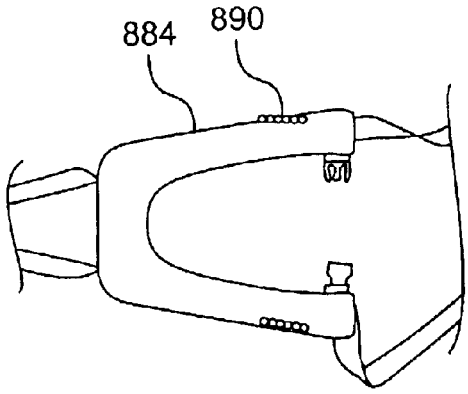

As shown in FIGS. 16*a*, 16*b*, and 16*c*, the entire internal mechanism of the flotation collar is placed within the outer exemplary outer protective cover, by the step of folding the materials 880 into the protective cover, from the legs up 881, until the final package is completed at 882. FIGS. 17*a* and 17*b* show front 883 and back 884 views, respectively, of an exemplary flotation collar with beaded handle area 890, as completely assembled, ready to use directly by a wearer or to be attached to other equipment worn by a wearer.

In describing representative embodiments of the invention, the specification may have presented the method and/or process of the invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the invention should not be limited to the performance of their steps in the order written, and one skilled in the art can readily appreciate that the sequences may be varied and still remain within the spirit and scope of the invention.

The foregoing disclosure of the embodiments of the invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

What I claim is:

1. A flotation collar comprising:

an outer protective cover;

an environmentally sealed cover;

multiple inflatable flotation cells, wherein the multiple inflatable flotation cells include a first flotation cell and a second flotation cell, wherein the second floatation cell is mounted behind the first flotation cell and is substantially offset from the first flotation cell in a plan view such that a front wall of the second flotation cell extends laterally beyond a periphery of the first flotation cell, the front wall being only partially covered by the first flotation cell; and means for inflating the multiple flotation cells, wherein a wearer is maintained in a substantially face up position in a body of liquid when the multiple flotation cells are inflated, wherein the wearer continues to be maintained in a substantially face up position if one of the multiple flotation cells fails to inflate or becomes deflated, and wherein the first and second flotation cells are separated by a common wall, the common wall forms only a part of the front wall of the second flotation cell and only a part of a rear wall of the first flotation cell.

2. The flotation collar of claim 1, further comprising an auxiliary means for inflating the flotation cells.

3. The flotation collar of claim 2, wherein the auxiliary means for inflating the flotation cells comprises at least one oral inflator connected to the flotation cells.

4. The flotation collar in claim 3, wherein stems for the oral inflator are in communication with the flotation cells.

5. The flotation collar of claim 1, further comprising means for securely fastening the flotation collar to the wearer.

6. The flotation collar of claim 5, wherein the means for securing the flotation collar to the wearer comprises at least one set of mechanical attachments attached to the outer protective cover.

7. The flotation collar of claim 1, wherein the shape and design of the inflated flotation collar secure the device to the wearer.

8. The flotation collar of claim 1, wherein the shape and volume of the inflated flotation collar promote the wearer into a face-up position above the liquid.

9. The flotation collar in claim 1, wherein the means for inflating the flotation cells comprises pneumatic inflation actuators.

10. The flotation collar of claim 9, wherein the means for inflating the flotation cells comprises $CO_2$ gas that is released when the actuators are triggered.

11. The flotation collar of claim 10, wherein the means for activating inflation of the flotation cells comprises at least one activation handle connected to the actuators, which inflates the flotation cells when the activation handle is pulled.

12. The flotation collar of claim 9, further comprising at least one activation handle, and wherein the flotation cells are inflated by pulling the handle.

13. The flotation collar of claim 9, wherein the outer protective cover is made from aramide fibers or films.

14. A flotation device comprising:

a first inflatable flotation cell;

a second inflatable flotation cell having no fluid communication with the first flotation cell; and an activation device for activating one or more the cells, wherein the second flotation cell is mounted behind the first flotation cell and is substantially offset from the first flotation cell in a plan view such that a front wall of the second flotation cell extends laterally beyond a periphery of the first flotation cell, the front wall being only partially covered by the first flotation cell, and wherein the first and second flotation cells are separated by a common wall, the common wall forms only a part of the front wall of the second flotation cell and only a part of a rear wall of the first flotation cell and is configured such that if one of the first and the second flotation cells is deflated, the other one of the first and second flotation cells maintains its inflated shape and rigidly, wherein the cells are partially constructed of rigid materials, and when the cells are inflated to a certain pressure, a wearer will be rotated in a face-up position while floating in a fluid body; and wherein the wearer continues to be maintained in a substantially face up position if one of the flotation cells fails to inflate or becomes deflated.

15. The flotation collar of claim 14, wherein the flotation cells are constructed of coated textile or film material.

16. The flotation collar of claim 4, wherein attachment straps are connected to flotation cells to secure the flotation cells to an environmentally-sealed cover.

17. The flotation collar of claim 16, wherein the environmentally-sealed cover houses the flotation cells to further secure the environmentally-sealed cover to the flotation cells.

18. The flotation collar of claim 17, wherein straps attached to the environmentally-sealed cover are threaded through grommets in an outer protective cover to secure the two covers together.

19. The flotation collar of claim 18, wherein a sealing mechanism secures the environmentally-sealed cover inside the outer protective cover.

20. The flotation collar of claim 19, wherein the outer protective cover has a sealing method that is easily separated when the flotation cells are inflated.

21. The flotation collar of claim 16, wherein the environmentally-sealed cover has a sealing device to protect from contaminants.

22. The flotation collar of claim 16, wherein the environmentally-sealed cover is further covered by an outer protective cover.

23. The flotation collar of claim 22, wherein the environmentally-sealed cover and the outer protective cover will not resist inflation of the cells.

24. A flotation device comprising:

multiple means for maintaining a user afloat in a fluid;

means for activating any of the multiple means for maintaining;

means for maintaining a user's body in a substantially upright position in the fluid; and means for housing the multiple means for maintaining in a substantially compact geometry, wherein the multiple means for maintaining a user afloat in a fluid include a first means for maintaining a user afloat in a fluid and a second means for maintaining a user afloat in a fluid, and wherein the second means for maintaining a user afloat in a fluid is mounted behind the first means for maintaining a user afloat in a fluid and is substantially offset from the first means in a plan view such that a front wall of the second means extends laterally beyond a periphery of the first means, the front wall being only partially covered by the first means, and wherein the first and second means is separated by a common wall, and wherein the first means has no fluid communication with the second means, and the common wall forms only a part of the front wall of the second means and only a part of a rear wall of the first means and is configured such that when one of the first and the second means for maintaining a user afloat in a fluid is deflated, the other one of the first and the second means maintains its inflated shape and rigidity.

25. A flotation device comprising:

multiple flotation cells, each flotation cell independently capable of maintaining a wearer substantially face up and afloat in a fluid;

a compressed gas container; and multiple activation mechanisms, each activation mechanism capable of activating the compressed gas cylinder to release gas into all of the flotation cells, wherein the multiple flotation cells include a first flotation cell and a second flotation cell, and wherein the second flotation cell is mounted behind the first flotation cell and is substantially offset from the first flotation cell in a plan view such that a front wall of the second flotation cell extends laterally beyond a periphery of the first flotation cell, the front wall being only partially covered by the first flotation cell, and wherein the first and second flotation cells are separated through a common wall, the first flotation cell has no fluid communication with the second flotation cell, the common wall forms only a part of the front wall of the second flotation cell and only a part of a rear wall of the first flotation cell and is configured such that if one of the first and the second flotation cells is deflated, the other one of the first and the second flotation cells maintains its inflated shape and rigidity.

* * * * *